US007252040B2

(12) United States Patent
Dumond

(10) Patent No.: US 7,252,040 B2
(45) Date of Patent: Aug. 7, 2007

(54) PORTABLE TABLE FOR A LAPTOP COMPUTER

(75) Inventor: Ronald P. Dumond, Fort Pierce, FL (US)

(73) Assignee: Intellectual Ventures, Inc., Stuart, FL (US)

( * ) Notice: Subject to any disclaimer, the term of this patent is extended or adjusted under 35 U.S.C. 154(b) by 63 days.

(21) Appl. No.: 11/198,112

(22) Filed: Aug. 5, 2005

(65) Prior Publication Data

US 2007/0028812 A1 Feb. 8, 2007

(51) Int. Cl.
*A47B 3/00* (2006.01)

(52) U.S. Cl. ..... 108/36; 108/169

(58) Field of Classification Search ..... 188/34, 188/36, 38, 35, 117, 132, 133, 129, 43; 248/188.1, 248/188.5, 188.6; 108/169, 168, 174, 173
See application file for complete search history.

(56) References Cited

U.S. PATENT DOCUMENTS

| | | | | |
|---|---|---|---|---|
| 134,149 | A | 12/1872 | King | |
| 1,063,642 | A | 6/1913 | Birdsall | |
| 1,086,746 | A | 2/1914 | Babbitt | |
| 1,770,955 | A | 7/1930 | Storm | |
| 2,326,461 | A | 8/1943 | Howe | |
| 2,508,627 | A | 5/1950 | Spiegel et al. | |
| 3,073,057 | A | 1/1963 | Farber | |
| 3,424,283 | A | 1/1969 | Sheldon | |
| 4,043,277 | A * | 8/1977 | Wallace | 108/35 |
| 4,258,833 | A | 3/1981 | Sims | |
| 4,412,604 | A | 11/1983 | Bell et al. | |
| 4,790,416 | A | 12/1988 | Baker | |
| 4,833,998 | A | 5/1989 | Everett et al. | |
| 4,927,128 | A | 5/1990 | O'Brian | |
| 5,009,170 | A | 4/1991 | Spehar | |
| 5,109,778 | A * | 5/1992 | Berkowitz et al. | 108/127 |
| 5,281,019 | A | 1/1994 | Rodeck | |
| 5,480,119 | A | 1/1996 | Fish et al. | |
| 5,535,683 | A | 7/1996 | Novak | |
| 5,660,117 | A | 8/1997 | Noble | |
| 6,068,355 | A | 5/2000 | Thorp | |
| 6,182,578 | B1 | 2/2001 | Fanuzzi | |
| 6,289,824 | B1 * | 9/2001 | Parker et al. | 108/115 |
| 6,431,086 | B1 | 8/2002 | Lloyd | |
| 6,637,350 | B2 | 10/2003 | McKsymick | |
| 6,811,006 | B1 | 11/2004 | Mundle | |
| 2002/0023811 | A1 | 2/2002 | Silvano | |
| 2002/0134697 | A1 | 9/2002 | Barnett | |
| 2003/0070591 | A1 | 4/2003 | Shabram, Jr. | |
| 2003/0177957 | A1 | 9/2003 | Ibrahim | |
| 2004/0007649 | A1 | 1/2004 | Vettraino | |
| 2004/0226791 | A1 | 11/2004 | Levy | |

FOREIGN PATENT DOCUMENTS

| | | |
|---|---|---|
| FR | 2592289 A1 | 7/1987 |
| GB | 2368786 A | 5/2002 |

* cited by examiner

*Primary Examiner*—José V. Chen
(74) *Attorney, Agent, or Firm*—GrayRobinson, P.A.

(57) ABSTRACT

This invention is directed to a portable table which is formed in two half sections movable between a folded position where they form a brief case and an unfolded position in which the half sections abut one another to define a planar table top capable of supporting a laptop computer, notebook and the like. The table top has a pair of legs which are adjustable both in the vertical and lateral directions.

18 Claims, 6 Drawing Sheets

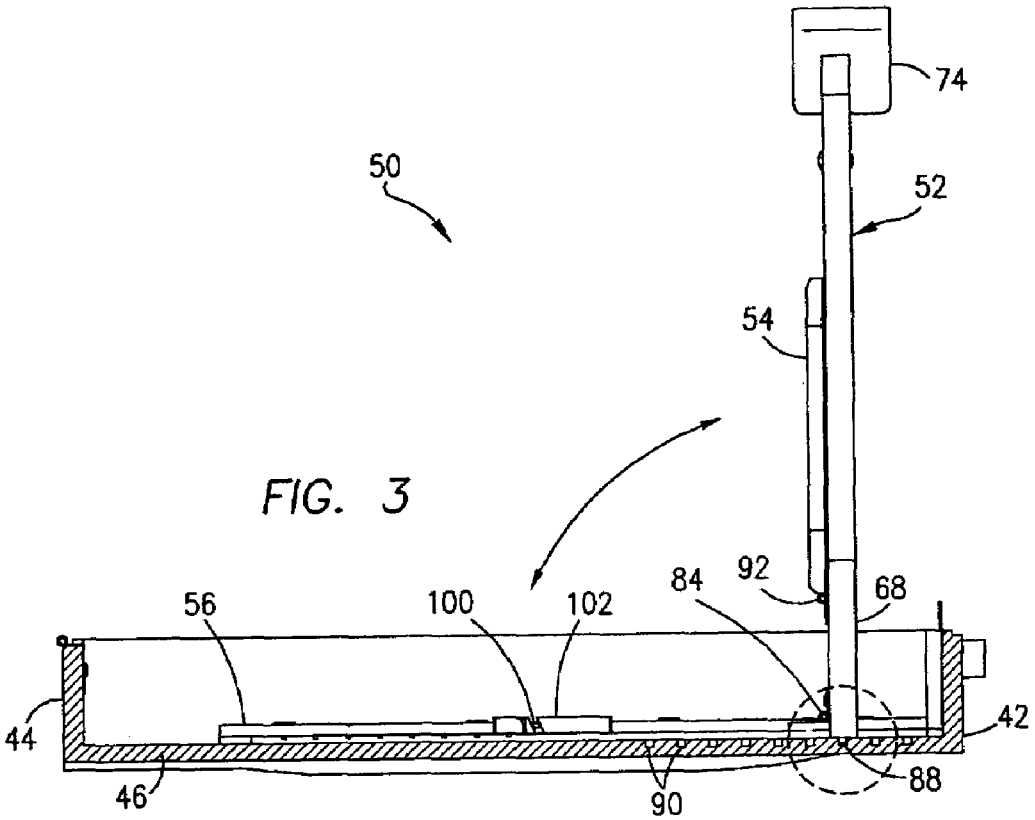
FIG. 3
FIG. 3A
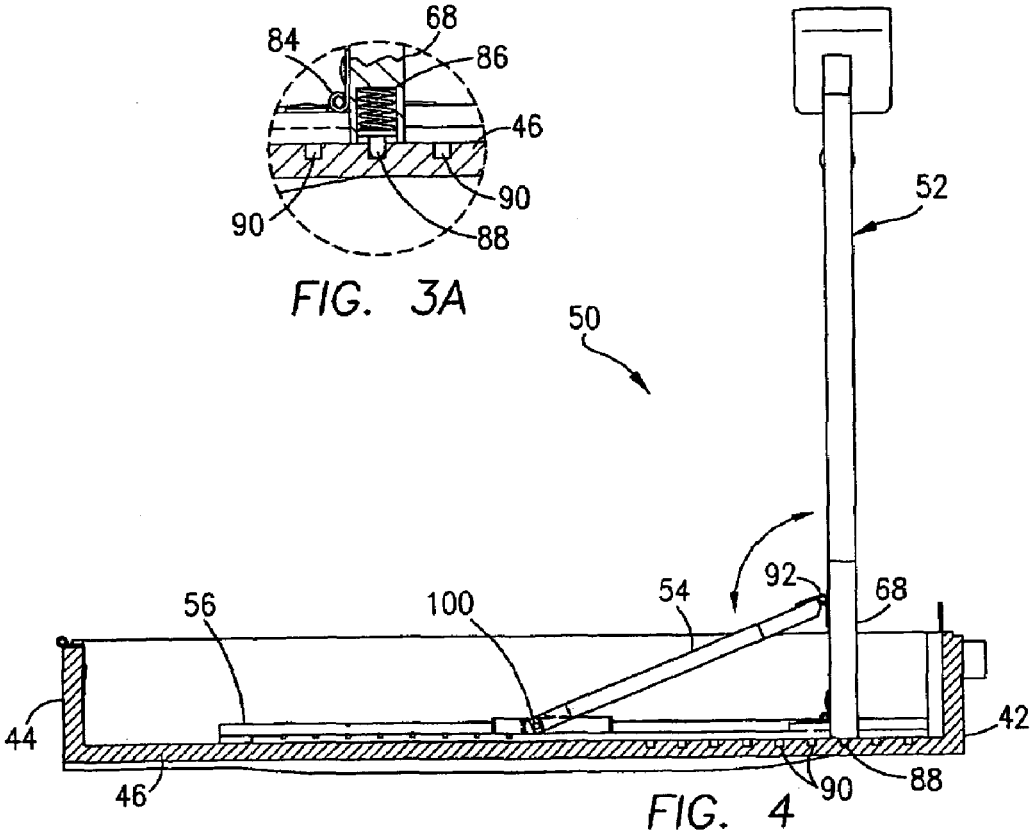
FIG. 4

PORTABLE TABLE FOR A LAPTOP COMPUTER

FIELD OF THE INVENTION

This invention relates to a portable table for a laptop computer or notebook, and, more particularly, to an apparatus consisting of two half sections movable between a closed position forming a brief case and an open position forming a planar table top which is supported by a pair of legs each capable of both vertical and lateral adjustment.

BACKGROUND OF THE INVENTION

In recent years, the trend toward miniaturization of electrical components has been especially apparent in the computer field. Large, bulky desk top computers continue to be replaced by laptop computers and notebooks which can match the performance and speed of desk tops but in a much smaller package. Laptop computers and notebooks have become increasingly thinner and lighter over the years, and are readily portable allowing users to take them on the road for work or recreation and remain in contact with the office or home via connections to the internet.

While laptop computers and notebooks are convenient from the standpoint of portability, they are not particularly easy to use especially when one is in transit. Use of the term "laptop" to identify these types of computers apparently came about by observing how one had to balance the machine on his or her lap when using it. Not all people are built the same, and it is difficult for some to easily rest the computer on the lap and still type or view the screen. Working on the computer for longer periods of time while supporting the computer on one's lap can be difficult for anyone. Although there are a number of cases for transporting laptop computers and notebooks, none provide a convenient and adjustable means of supporting the machine while it is in use.

SUMMARY OF THE INVENTION

This invention is directed to a portable table for a laptop computer which is formed in two half sections movable between a folded position where they form a brief case and an unfolded position in which the half sections abut one another to define a planar table top capable of supporting a laptop computer, notebook and the like. The two half sections of the brief case which form the tabletop are connected by a central hinge, and are supported by a pair of legs movable between a retracted position and an extended position.

One aspect of this invention is the provision of adjustment structure for the legs allowing them to be moved laterally, e.g. toward and away from one another. Each leg is mounted by a hinge to a leg support plate which is laterally movable along a slotted rail carried by each of the half sections. To obtain adjustment of the legs toward and away from one another, one or both of the legs is tilted from the upright, extended position and then moved with the leg support plate along the slotted rail. When in the desired lateral position, one or both of the legs is folded upright so that a spring-biased pin on the edge of the leg extends into an adjustment hole formed in the outer wall of a respective half section. Engagement between the spring-biased locking pin and a hole in the outer wall releasably locks each leg in place. The legs are each supported in the upright, extended position by a leg brace which is pivotal from a collapsed position against the leg to an extended position. In the extended position, rods at the outermost edge of each leg brace engage leg brace mounts fixed to the mounting plate.

In addition to lateral adjustment of the legs toward and away from one another, both legs are vertically adjustable, e.g. their overall length can be varied. Each leg has an upper panel which is connected by the hinge to the leg support plate, and a lower panel which telescopes with respect to the upper panel. The lower panel is formed with spaced notches along one edge, and a foot at the base. A spring-loaded pin mounted to the upper panel of the leg is positioned to engage each of the notches. The pin may be retracted, the telescoping lower panel moved vertically within the upper panel of the leg to either shorten or lengthen its overall length dimension and then the pin may be inserted into another notch to secure the two panels together.

The lateral and vertical adjustments of the legs provided by the present invention allow a user to place his or her laptop computer on the table top and sit on the floor or in a chair with the table top comfortably adjusted according to the size of the person and where he/she is sitting. Larger people may adjust the legs farther apart, and the tabletop higher, than smaller people, as desired. Further, the size of a chair may dictate how far apart the legs should be spaced from one another in order to rest comfortably on the chair, and the lateral adjustment feature herein accommodates chairs of all sizes.

DESCRIPTION OF THE DRAWINGS

The structure, operation and advantages of this invention will become further apparent upon consideration of the following description, taken in conjunction with the accompanying drawings, wherein:

FIG. 3 is side view in partial cross section of one half section of the portable table with the leg in an upright positions and the leg brace collapsed;

FIG. 3A is an enlarged, cross sectional view of the encircled portion of FIG. 3;

FIG. 4 is a view similar to FIG. 3 except with the leg brace in the extended position;

DETAILED DESCRIPTION OF THE PREFERRED EMBODIMENT

Figure 1:
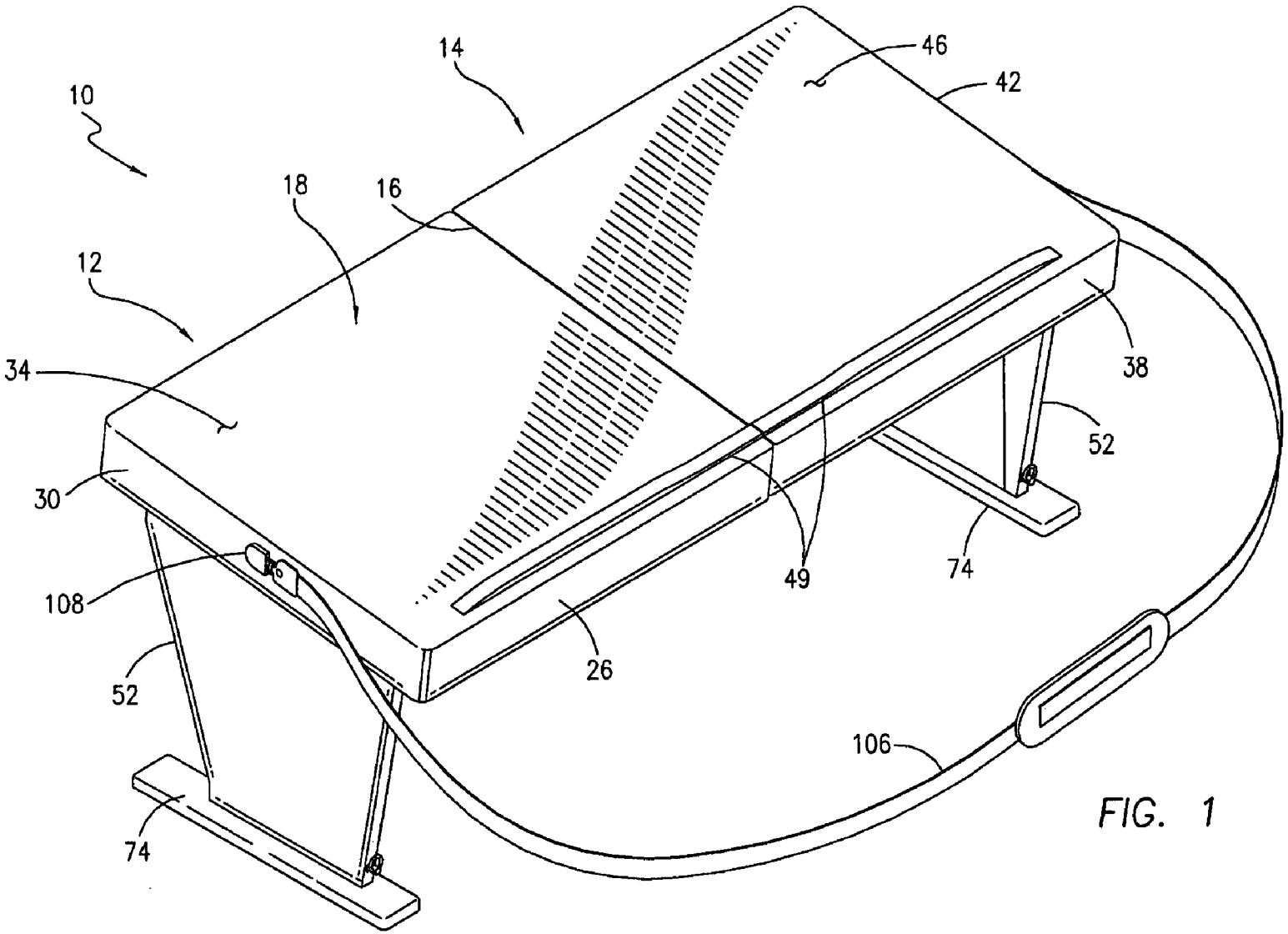
FIG. 1 is a perspective view of the portable table of this invention in the open position.
Figure 9:
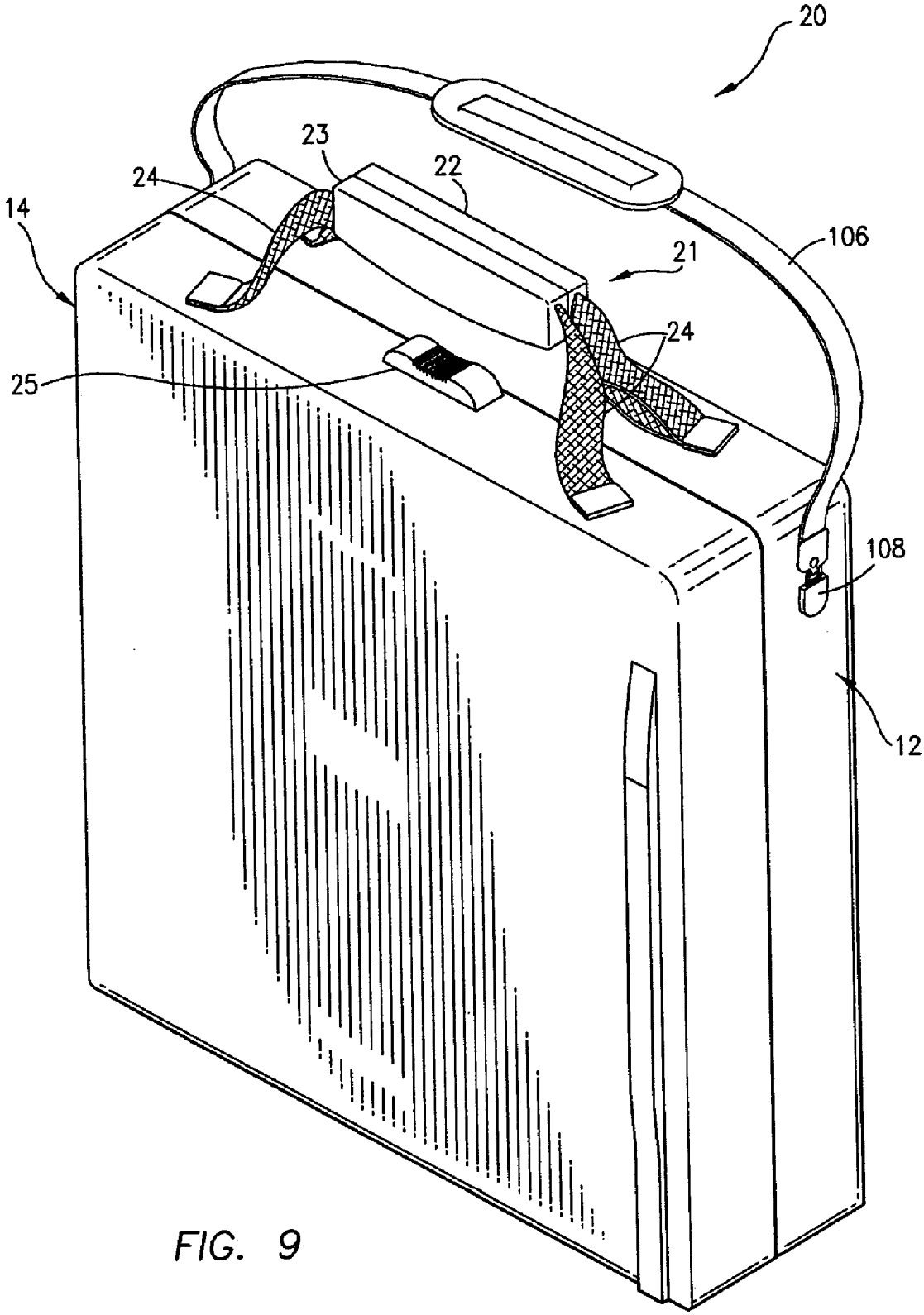
FIG. 9 is a perspective view of the portable table in a closed position forming a brief case.

Referring initially to FIGS. 1 and 9, the portable table 10 of this invention includes a first half section 12 and a second half section 14 which are pivotally connected by a hinge 16 and movable between an open position shown in FIG. 1 to form a table top 18, and a closed position depicted in FIG.

9 to form a brief case 20. The brief case 20 has a handle 21 formed in two parts 22 and 23. Each part 22 and 23 is mounted by a pair of straps 24 to respective half sections 12 and 14. The handle parts 22, 23 are connected together for transport of the brief case 20, and can be disconnected when the brief case 20 is opened to form essentially two "half handles," one for each of the half section 12 and 14, which the user may grasp to aid in moving the table 10 when in the open position. See FIG. 2. A latch 25 retains the half sections 12, 14 of the brief case 20 in the closed position.

Figure 2:
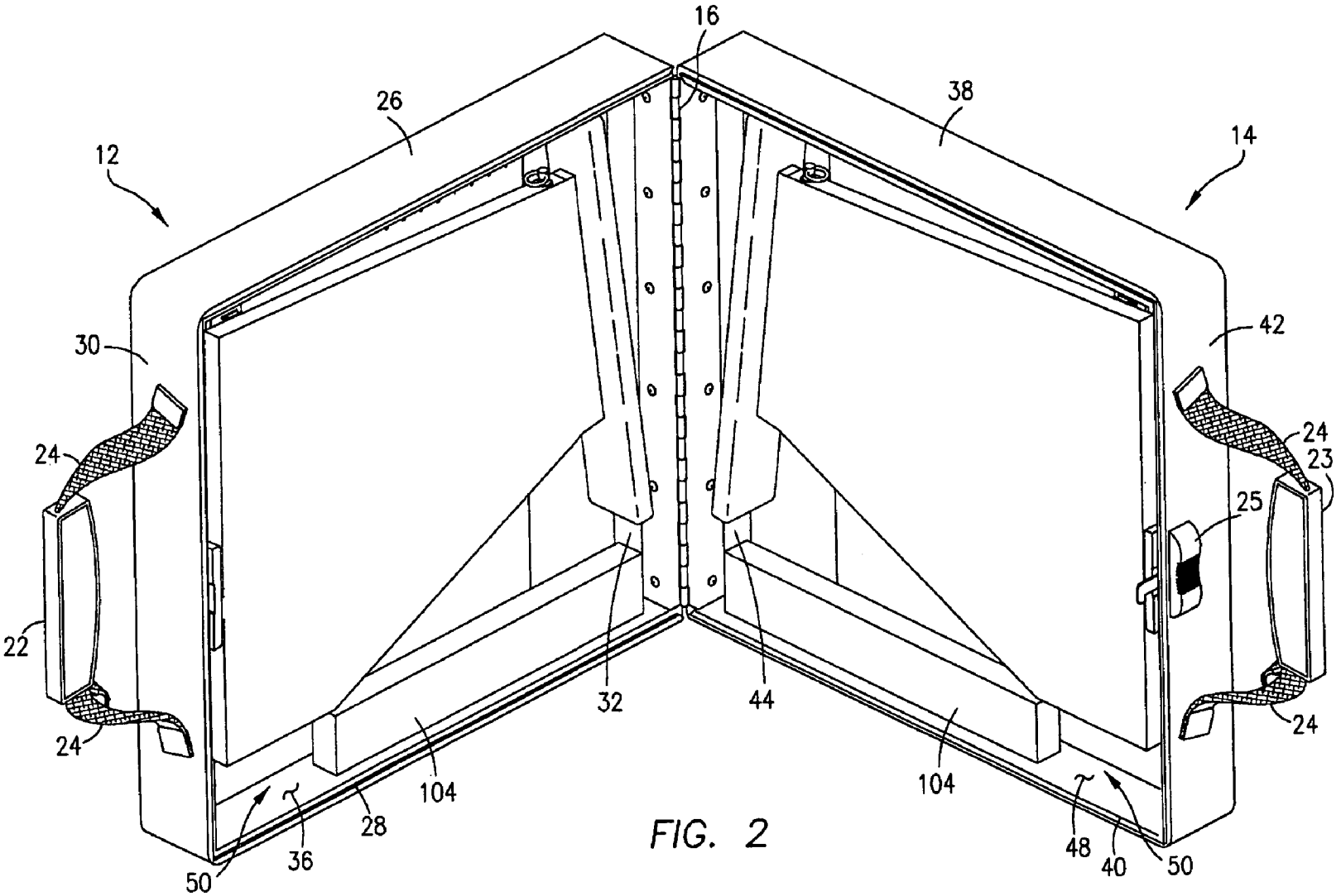
FIG. 2 is a perspective view of the portable table with the legs in the collapsed position, and the half sections of the table partially closed.

With further reference to FIG. 2, the first half section 12 is formed with opposed side walls 26 and 28, opposed end walls 30 and 32, and, an outer wall 34 which are interconnected to form an enclosure with an open interior 36. Similarly, the second half section 14 has opposed side walls 38 and 40, opposed end walls 42 and 44, and, an outer wall 46 connected together to form an enclosure with an open interior 48. The hinge 16 is connected to the end walls 32 and 44 of respective half sections 12 and 14. With the portable table 10 in the open position, the end walls 32, 44 abut one another, and the outer walls 34, 46 of the two half section 12, 14 form the generally planar table top 18. Each outer wall 34 and 46 may also mount a stop 49 positioned to engage and retain the laptop computer or notebook on the table top 18 when it is in use.

An important aspect of this invention is the adjustable manner in which the table top 18 is supported with the portable table 10 in the open position. Each of the half sections 12, 14 mount a leg assembly 50, best seen in FIGS. 1 and 2. For purposes of the present discussion, each "leg assembly" 50 is considered to include a leg 52, a leg brace 54, a leg support plate 56, leg brace mounts 58 and 60, slotted rails 62 and 64, and, leg locking structure 66. The leg assembly 50 of each half section 12 and 14 is structurally and functionally the same, and therefore only the leg assembly 50 associated with the half section 14 is described in detail, it being understood that the same explanation applies to the leg assembly 50 of the half section 12.

Figure 7:
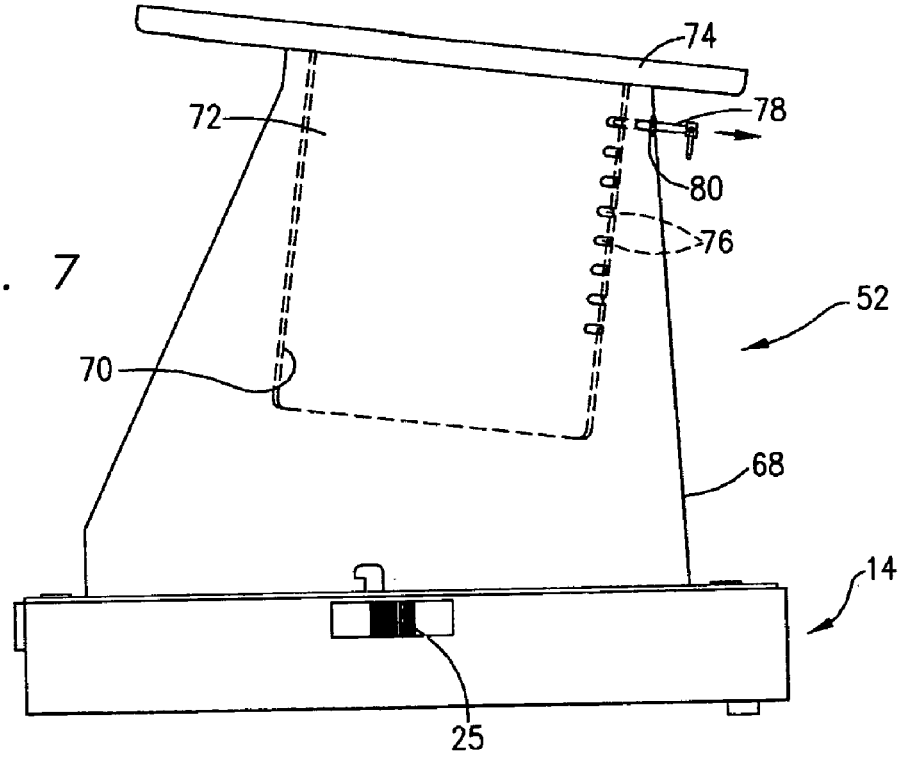
FIG. 7 is a side view of one of the half sections depicting the leg construction and its vertical adjustment feature, with the leg in a fully retracted position.
Figure 8:
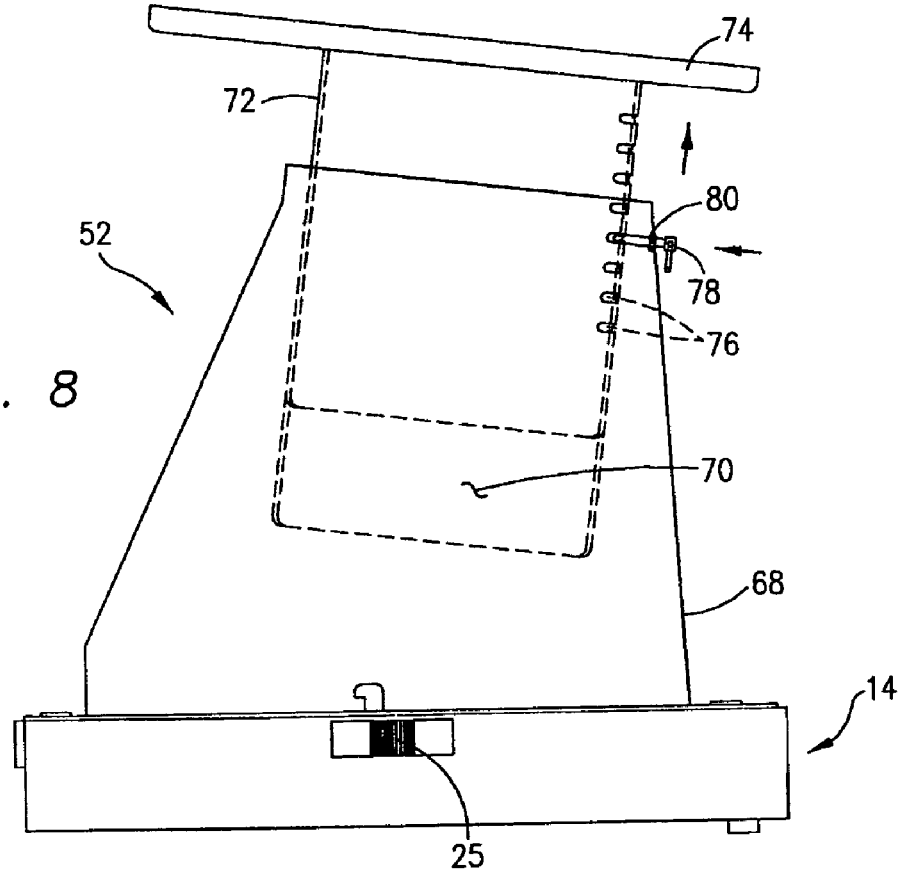
FIG. 8 is view similar to FIG. 7 except with the leg partially extended.

Referring initially to FIGS. 7 and 8, the leg 52 of each leg assembly consists of an upper panel 68 formed with a cavity 70 which receives a lower panel 72. The lower panel 72 is movable in a telescoping fashion within the cavity 70, and mounts a foot 74 at its free end. In the presently preferred embodiment, the lower panel 72 is formed with a number of spaced notches 76 which selectively align with a pin 78 carried by the upper panel 68. The pin 78 is biased into engagement with a notch 76 by a spring 80. In order to adjust the length of the leg 52, and therefore the height of the table top 18, the pin 78 is retracted from one notch 76 allowing the lower section to be moved within the cavity 70 of upper panel 68 to the desired position, at which time the pin 78 is released into engagement with another notch 76. The leg 52 is shown in the fully retracted position in FIG. 7, and in a partially extended position in FIG. 8. It is noted that the base of the upper and lower panels 68 and 72 is angled, and, hence, the foot 74, so that the table top 18 is also oriented at an angle relative to horizontal. This facilitates typing on the keyboard, and viewing of the screen, when a laptop computer or notebook is placed on the table top 18.

Referring now to FIGS. 2-6, the remaining structure of the leg assembly 50 is shown which permits lateral adjustment of the leg 52 of each half section 12, 14. The term "lateral" as used herein refers to a direction of movement of the legs 52 of respective half sections 12, 14 toward and away from one another. The side walls 38 and 40 of half section 14 mount the slotted rails 62 and 64, respectively, which face on another within the hollow interior 48. The slot 82 within each slotted rail 62, 64, one of which is shown in FIG. 2, receive the side edges of the leg support plate 56. As described below, the leg support plate 56 is laterally movable along the slotted rails 62, 64 within the slots 82.

The upper panel 68 of leg 52 is pivotally connected by a hinge 84 to the leg support plate 56. The upper edge of the upper panel 68 is formed with a recess which receives a spring 86 connected at one end to a locking pin 88. As discussed in more detail below in connection with a description of the lateral adjustment of leg 52, the locking pin 88 is inserted into one of a number of spaced holes 90 formed in the outer wall 46 of half section 14 to lock the leg assembly 50 in place.

The leg 52 is pivotal on hinge 84 between an upright, extended position substantially perpendicular to the leg support plate 56 (FIGS. 3 and 4), and a collapsed position against the leg support plate 56 (FIG. 2). In order to provide additional support to the leg 52 in its upright position, and rigidity to the table top 18 when in use, the leg brace 54 is provided. One end of the leg brace 54 is mounted by a hinge 92 to the upper panel 68 of the leg 52, and its opposite end has a pair of spaced arms 94 each formed with a slot 96 spanned by a rod 98. The leg brace 54 is movable between a retracted position where it rests against the leg 52 as seen in FIG. 3, and an extended position shown in FIGS. 4-6. In the extended position, the rod 98 of each arm 94 of leg brace 54 is received within the spring-biased catch 100 of a leg brace mount 102 carried on the leg support plate 56. Each catch 100 retains a rod 98 in place, but then releases to allow the rods 98, and hence the leg brace 54, to disengage from the leg support mounts 54.

Figure 5:
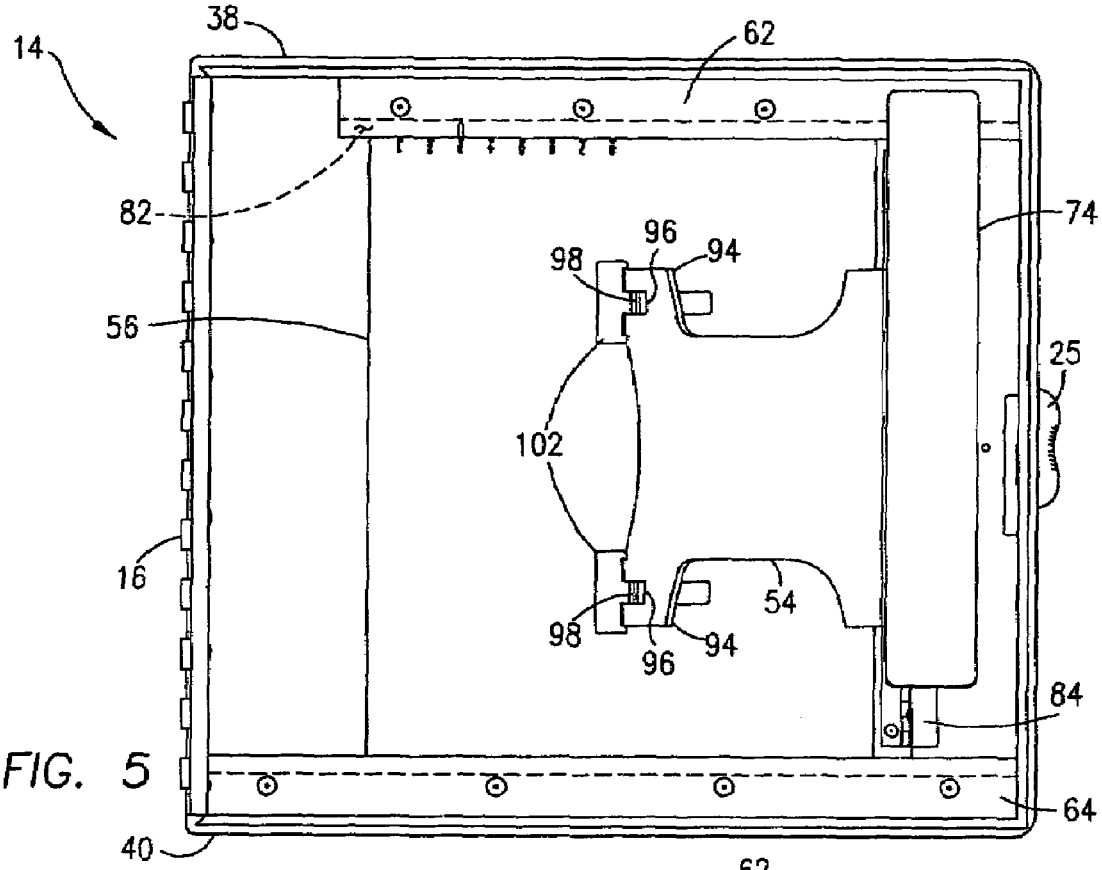
FIG. 5 is plan view of one of the half sections with the leg and leg brace each in the extended position and the leg support plate in one lateral position.

Lateral adjustment of the leg assembly 50 and leg 52 is obtained as follows. With the leg assembly 50 in a position such as shown in FIGS. 4 and 5 with the leg 52 in the upright, extended position and the leg brace 54 also extended, it can be observed that the locking pin 88 at the upper end of the leg 52 engages one of the holes 90 in the outer wall 46. Initially, the leg brace 54 is moved to its collapsed position against the leg 52 by lifting the rods 98 out of the spring-biased catch 100 of each leg brace mount 102. This allows the leg 52 to be tilted or pivoted on hinge 84 relative to the outer wall 46 causing the locking pin 88 to disengage the hole 90 in which it had resided. It should be noted that the leg brace 54 need not be placed in its fully collapsed position, but it must disengage the leg brace mounts 102 so that the leg 52 can be pivoted.

Figure 6:
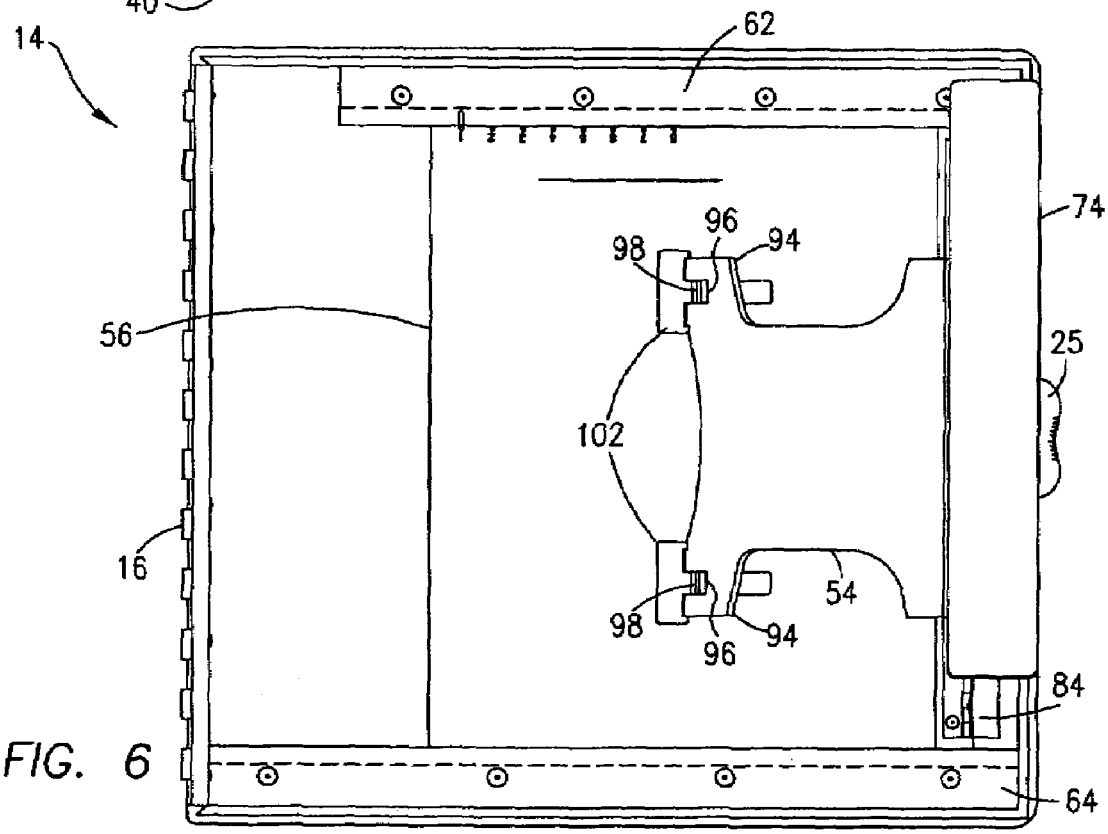
FIG. 6 is a view similar to FIG. 5 except with the leg support plate in a different lateral position.

With the leg 52 in a pivoted position, the leg support plate 56, leg 52 and leg brace 54 may be moved as a unit in a lateral direction, e.g. toward or away from the leg 52 of the other half section 12. As noted above, the side edges of the leg support plate 56 slide within the slot 82 formed in respective rails 62 and 64 during lateral adjustment. When the leg 52 is in the desired position, it is pivoted to an upright, extended position and may have to be moved laterally one way or the other slightly until its locking pin 88 aligns with one of the holes 90 in the outer wall 46. The spring 86 forces the locking pin 88 into such hole 90, thus locking the leg 52 in that location so long as the leg 52 remains in the upright position. The leg brace 54 is then returned to its extended position, such that the rods 98 engage the catches 100 of the leg brace mounts 102, to secure the leg 52 in its upright position. Two different lateral positions of the leg 52 are shown in FIGS. 5 and 6.

As best seen in FIG. 2, in order to close the portable table 10 into a brief case 24, the leg 52 carried by each half section 12 and 14 is placed in the fully retracted position against the leg support plate 56. In the presently preferred embodiment, sufficient space is left within the interior 36 and/or 48 of the half sections 12, 14 to receive and mount a laptop computer or notebook and charger (not shown) when the half sections 12, 14 are fully closed. One or more foam strips 104 are mounted within each half section 12, 14 to support the computer or notebook.

As discussed above, the legs 52 of each half section 12 and 14 are adjustable in a lateral direction, toward and away from one another, to accommodate the size of the chair or other support where the one is seated when using the portable table 10. Depending upon the depth of the chair or support, the foot 74 at the base of each leg 52 may not rest entirely on the chair or support. As illustrated in FIGS. 1 and 9, a shoulder strap 106 is provided to transport the brief case 20 on one's shoulder instead or using the handle 21. Opposite ends of the shoulder strap 106 are mounted to the case 20 by clips 108, one of which is shown in FIG. 9. The shoulder strap 106 may be disconnected from the clips 108 and used to help secure the portable table 10 on a chair or other support. With reference to FIG. 1, each end of the shoulder strap 106 may be connected by a clip 108 to approximately the center of the side walls 30 and 42 of respective half sections 12 and 14. In this position, the shoulder strap 106 may be extended around the torso of the user, such that the strap 106 is pinned between the back of the user and the back rest of the chair, thus stabilizing the portable table 10 on the chair when in use.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out the invention, but that the invention will include all embodiments falling within the scope of the appended claims.

What is claimed is:

1. A portable table, comprising:

a first half section pivotally connected to a second half section, said first and second half sections being movable between a closed position and an open position in which an outer wall of each of said half sections collectively form a table top;

each of said first and second half sections having a leg assembly comprising:

(i) a leg including a first panel and a second panel which telescopes relative to said first panel to selectively adjust the length of said leg;

(ii) a leg support plate connected to said leg so that said leg is moveable between an upright position and a collapsed position relative to said leg support plate;

(iii) leg locking structure acting between said first panel of said leg and said outer wall of a half section to releasably secure said leg and said support plate to said outer wall;

said leg support plate of each of said first and second half sections being movable toward and away to selectively adjust the spacing between said legs connected thereto.

2. The portable table of claim 1 in which each of said first second half sections includes opposed side walls and opposed end walls which are interconnected to one another and mounted to said outer wall to form an enclosure with an open interior.

3. The portable table of claim 2 in which one of said end walls of said first half section is pivotally connected by a hinge to one of said end walls of said second half section.

4. The portable table of claim 2 in which said leg assembly further includes a slotted rail mounted to each of said side walls within said interior of each of said first and second half sections, said leg support plate of each of said first and second half sections having opposed sides movable along said slotted rails.

5. The portable table of claim 1 in which said leg locking structure includes a number of spaced holes formed in said outer wall and a locking pin connected to one end of a spring carried by said first panel of said leg, said locking pin being biased by said spring and received within one of said spaced holes with said leg oriented in said upright position, said locking pin disengaging said hole thus allowing said leg support plate and said leg to move along said outer wall of respective first and second half sections when said leg is pivoted from said upright position.

6. The portable table of claim 1 further including a leg brace for said leg of each of said first and second half sections, each of said leg braces being pivotally mounted to said leg and moveable between a collapsed position against said leg and an extended position release ably connected to said leg support plate.

7. The portable table of claim 6 in which said leg brace has a pair of spaced arms each formed with a slot with a rod which spans said slot, said leg support plate mounting a pair of spaced leg brace mounts each having a catch which engages said rod of one of said arms to releaseably secure said leg brace in the extended position.

8. The portable table of claim 1 in which said second panel of said leg is formed with a number of spaced notches, said first panel of said leg mounting a spring-biased pin which is insertable into a selected notch of said second panel to vary the length of said leg.

9. The portable table of claim 1 further including a strap connected at one end to said first half section and connected at an opposite end to said second half section, said strap having sufficient length to extend around the torso of a user of the portable table with said first and second half sections in the open position to form said table top.

10. A portable table, comprising:

a first half section pivotally connected to a second half section, said first and second half sections being pivoted between an open position in which outer walls of said half sections form a table top and a closed position in which said half sections form a brief case;

a first leg assembly carried by said first half section and a second leg assembly carried by said second half section, each of said first and second leg assemblies including a leg movable between an extended position and a retracted position, each of said legs having a first panel and a second panel which telescope relative to one another to permit selective adjustment of the length of said legs, said first and second leg assemblies each including a leg support plate movable along respective first and second half sections to permit movement of said first and second leg assemblies toward and away from one another, and, said first and second leg assemblies each including leg locking structure for releasably locking said leg thereof to said outer wall of a respective first and second half section with said leg in said extended position.

11. The portable table of claim 10 in which each of said first second half sections includes opposed side walls and opposed end walls which are interconnected to one another and mounted to said outer wall to form an enclosure with an open interior.

12. The portable table of claim 11 in which one of said end walls of said first half section is pivotally connected by a hinge to one of said end walls of said second half section.

13. The portable table of claim 10 in which said leg assembly further includes a slotted rail mounted to each of said side walls within said interior of each of said first and second half sections, said leg support plate of each of said first and second half sections having opposed sides movable along said slotted rails.

14. The portable table of claim 10 in which said leg locking structure includes a number of spaced holes formed in said outer wall and a locking pin connected to one end of a spring carried by said first panel of said leg, said locking pin being biased by said spring and received within one of said spaced holes with said leg oriented in said upright position, said locking pin disengaging said hole thus allowing said leg support plate and said leg to move along said outer wall of respective first and second half sections when said leg is pivoted from said upright position.

15. The portable table of claim 10 further including a leg brace for said leg of each of said first and second half sections, each of said leg braces being pivotally mounted to said leg and moveable between a collapsed position against said leg and an extended position releasably connected to said leg support plate.

16. The portable table of claim 15 in which said leg brace has a pair of spaced arms each formed with a slot with a rod which spans said slot, said leg support plate mounting a pair of spaced leg brace mounts each having a catch which engages said rod of one of said arms to releasably secure said leg brace in the extended position.

17. The portable table of claim 10 in which said second panel of said leg is formed with a number of spaced notches, said first panel of said leg mounting a spring-biased pin which is insertable into a selected notch of said second panel to vary the length of said leg.

18. The portable table of claim 10 further including a strap connected at one end to said first half section and connected at an opposite end to said second half section, said strap having sufficient length to extend around the torso of a user of the portable table with said first and second half sections in the open position to form said table top.

* * * * *